United States Patent [19]

Okamoto et al.

[11] 4,234,022

[45] Nov. 18, 1980

[54] WOVEN FABRIC

[75] Inventors: Miyoshi Okamoto, Takatsuki; Syusuke Yoshida; Shigeru Inada, both of Otsu, all of Japan

[73] Assignee: Toray Industries, Inc., Tokyo, Japan

[21] Appl. No.: 967,487

[22] Filed: Dec. 7, 1978

[30] Foreign Application Priority Data

Dec. 9, 1977 [JP] Japan ..... 52-147173

[51] Int. Cl.[3] ..... D03D 15/00

[52] U.S. Cl. ..... 139/420 R; 139/426 R

[58] Field of Search ..... 139/383 R, 383 A, 420 R, 139/420 A, 426 R; 57/251, 245, 905; 428/248, 290, 374; 28/115, 162

[56] References Cited

U.S. PATENT DOCUMENTS

| | | | |
|---|---|---|---|
| 2,554,034 | 5/1951 | Koester et al. | 139/426 |
| 2,596,803 | 5/1952 | Williamson et al. | 139/383 R |
| 3,296,062 | 1/1967 | Truslow | 139/426 R |
| 3,531,368 | 9/1970 | Okamoto et al. | 57/905 |
| 3,865,678 | 2/1975 | Okamoto | 28/162 |
| 4,122,658 | 11/1978 | Morioka et al. | 57/245 |

*Primary Examiner*—Henry Jaudon

*Attorney, Agent, or Firm*—Miller & Prestia

[57] ABSTRACT

A novel woven fabric of triple-weft weave in accordance with this invention comprises a floating first weft and a floating third weft each comprising filamentary or spun yarns consisting mainly of extra fine fibers or filaments having extra fine denier. It further comprises a second weft of heavier denier woven between said first and third wefts and a warp of relatively heavy denier.

The fabric of this invention has excellent characteristics such as good crease resistance, permanent pleatability, excellent resiliency, soft touch on both front and back fabric surfaces, usefulness to an apparel without lining and reversible high quality.

13 Claims, 4 Drawing Figures

WOVEN FABRIC

The present invention relates to a special woven fabric of triple weft weave.

Heretofore, knitted fabrics and woven fabrics using extra fine fibers have been known. These fabrics have had a unique silk-like luster and an excellent touch. However, when all of the fibers of which the fabric is composed consist of extra fine fibers, the fabric tends to have a somewhat limp feel, tends to crease easily and cannot readily be permanently pleated. Accordingly, such a fabric tends to have limited commercial value in many cases.

In order to avoid these drawbacks, it has been proposed to apply to such woven or knitted fabric elastic high molecular weight substances such as polyurethanes, silicones, (including those having post reactivity) and resins of the polyacryl series. While such treatments are effective in some ways, they are subject to various drawbacks such as expense, hard or rubbery feel, color unbalance between fibers and polyurethane, nap deterioration, yellowing of fabric, inferior color fastness and difficulty in permanent pleating.

Synthetic suedes of especially high quality, presenting elegant, soft surfaces, have been produced by needle-punching of individual fibers to make a non-woven fabric, and impregnating the fabric. U.S. Patents relevant to this process and to products obtained thereby are those to Okamoto et al U.S. Pat. No. 3,774,273, Okamoto et al No. 3,859,698, Okazaki et al No. 3,873,406, Okamoto et al No. 3,877,120, Okazaki et al No. 3,899,292, Okazaki et al No. 3,899,623, and Okazaki et al No. 3,908,060, all assigned to the assignee hereof, the disclosures of which are incorporated herein by reference.

It is one of the objects of this invention to produce synthetic suede fabrics having excellent quality by utilizing a weaving process.

We have heretofore proposed in U.S. Pat. application Ser. No. 745,161, filed Nov. 26, 1976, now abandoned, the preparation of knitted or woven fabrics using doubled extra fine filaments that are knitted or woven in a manner to produce fabrics having excellent touch, excellent crease resistance, permanent pleating qualities, and excellent hand. These fabrics use filaments of ordinary denier as warp and weft, to make the most of such filaments and to supplement the drawbacks of extra fine fibers, while at the same time using extra fine filaments as a part of the weft.

It has also been heretofore proposed, in the Okamoto et al U.S. Pat. No. 3,865,678, assigned to the assignee hereof, to produce a suede-like fabric from a woven yarn, using "islands-in-a-sea" extra fine fibers or filaments as floating weft yarns and using crimped fibers as warp yarns. However, in subsequent treatment for "raising" the nap, when an excessive number of floating wefts are used, the wefts tend to be formed into large loops, making it difficult to obtain high quality raised fibers in the form of downy fibers or small loops. The weakness of the crimped warps is a factor as well. Further, in accordance with the aforementioned '678 patent an elastic polymer is impregnated throughout the fabric.

Because of human demand, many new requirements have been imposed upon these knitted and woven fabrics. In some fields of use, strong demands have been made for comparable elegance on the back surface, in addition to front surface elegance. When an excellent touch or hand can be provided on both the front and back surfaces of a fabric its value and usefulness are greatly improved because both the front and back can be used as a high-quality suede-like material. Despite the fact that some fabrics are relatively thick, it is nevertheless of great advantage to provide feel and elongation characteristics which are similar to those of woven and knitted fabrics, not the feel and elongation characteristics (in all longitudinal, transverse and diagonal directions) of a non-woven fabric.

In some cases, differences have been sensed with respect to slipperiness of the front surface of the fabric relative to the back surface, and there has been a need to overcome this drawback. In still other cases, there has been a requirement that such fabrics shall be high quality suede-like reversible fabrics.

However, these requirements have been extremely difficult to attain, and have not heretofore been achieved.

In Example 13 of the revised specification of Laid-Open Japanese Patent Application No. 92650/1973, made public on Nov. 16, 1976, an attempt was described to prepare a woven fabric both of whose surfaces were raised and covered with naps of extra fine fibers. This attempt comprised using spun yarn consisting of extra-fine fibers as first and second wefts in weaving a double 5-harness satin fabric, and raising extra-fine fibers which floated on the front and back surfaces of the fabric. However, this woven fabric was not practical, especially for apparel uses, in that:

(1) It tended to crease.

(2) Its feel or handle tended to be limp, and it lacked fabric resistance.

(3) Its thickness was excessive and it was too full-bodied.

It is an object of the present invention to create a new fabric having a new structure and having properties satisfying the various demands heretofore mentioned.

The present invention overcomes the objections of the prior art by providing a novel triple-weft woven structure.

Woven fabrics of triple-weft weave are known. However, there has heretofore been no example of a woven fabric using extra fine fibers or filaments in a triple-weft weave.

Conventional triple knitted and woven fabrics have heretofore had little practical or industrial value. They have been produced only very rarely, there are only a few operative spinning machines available therefor, and such fabrics have been and are rather rare.

Triple woven fabrics according to the present invention are special woven fabrics comprising not merely a triple woven structure, but characterized by the introduction of extra fine fibers or filaments. This invention represents a combination thereof with one or more relatively heavy denier fibers or filaments and is directed to the distribution of said extra fine fibers or filaments to special portions of the fabric, thereby creating a unique textile weave, as will be illustrated in further detail hereinafter. Due to its usefulness, to be mentioned in detail later, the commercial value of such fabric is very substantial.

The novel woven fabric of triple-weft weave in accordance with this invention comprises a floating first weft and a floating third weft each comprising filamentary or spun yarns consisting mainly of extra fine fibers or filaments having a denier of less than about 0.7. It further comprises a second weft of heavier denier woven between said first and third wefts. It further comprises a warp of relatively heavy denier. Both the second weft and the warp are composed of the same or different filamentary yarns or spun yarns consisting mainly of fibers or filaments having a denier of about 1–20, preferably 5–15.

This novel fabric is characterized in that the first weft is woven in a manner to skip over about 2–12 warps in the manner of a floating weft, and is caused to float more than the other wefts on one surface of the fabric. Further, the third weft is also a floating weft and is caused to float more than the other wefts on the other fabric surface. This produces a highly novel and valuable fabric.

BRIEF DESCRIPTION OF THE DRAWINGS

In FIGS. 1–4, the color red (A) is used as the first weft, black (B) as the second weft, blue (C) as the third weft and green (D) as the warp. As shown in these figures, on the front surface the first weft floats more than the second and third wefts, and on the back surface the third weft floats more than the first and the second wefts.

DETAILED EXPLANATION OF THE PRESENT INVENTION

Figure 1:
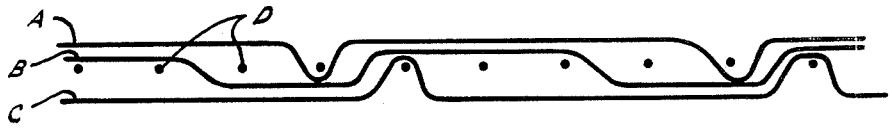
FIGS. 1 and 2 are directed to the fabric shown in Examples 1, 2, 3 and 4.
Figure 2:
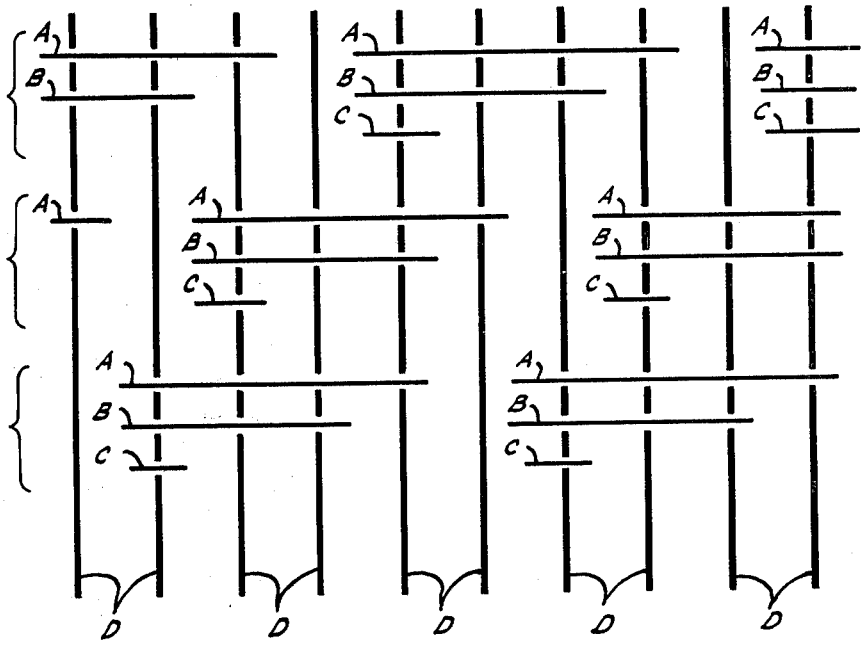
Figure 3:
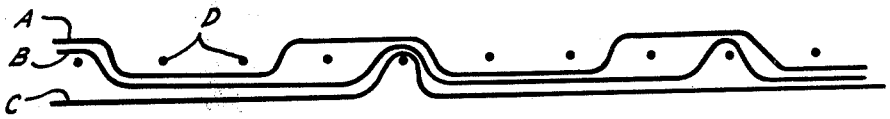
FIGS. 3 and 4 are directed to the fabric shown in Example 5.
Figure 4:
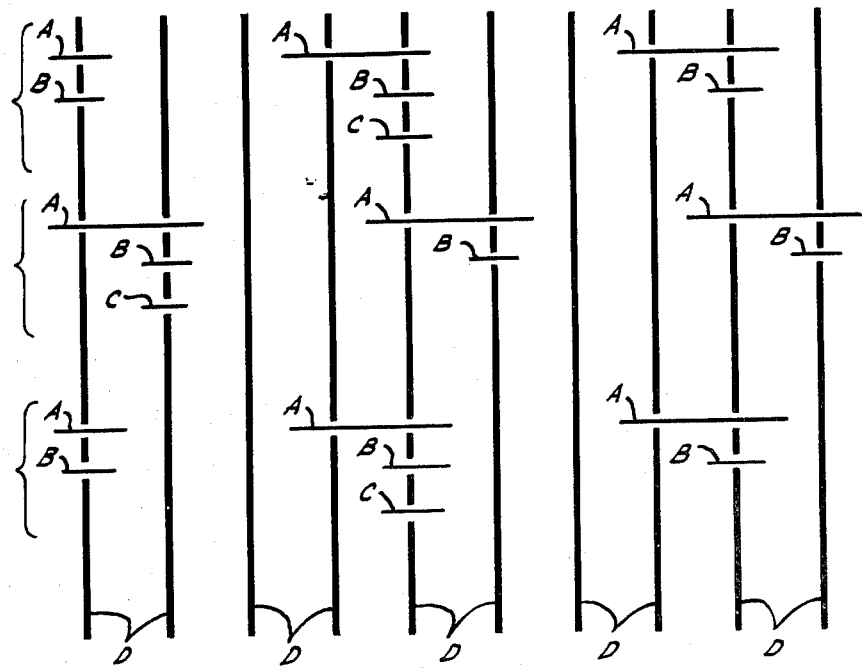

The woven fabric of the present invention has a triple-weft woven structure. The first weft is a floating weft comprising a filamentary yarn or a spun yarn consisting mainly of extra fine fibers or filaments of less than about 0.7 denier, preferably less than about 0.3 denier, and expecially preferably about 0.03–0.25 denier.

The third weft, also a floating weft, contains extra fine fibers or filaments corresponding essentially to the same definition as the first weft, i.e., it should consist mainly of fibers or filaments of less than about 0.7 denier, preferably less than about 0.3 denier, and especially preferably about 0.03–0.25 denier. The third weft may be substantially the same as the first weft or may differ significantly from the first weft within the defined range. The preferred conditions and functional effects of the third weft are essentially the same as those of the first weft, since they are both composed of ultrafine fibers or filaments.

When a raised condition or silk-like luster is desired on the back surface of the fabric, to the same degree as that of the front surface, the first weft and the third weft may be woven in the same pattern or manner. In order to avoid producing a fabric having an excessively full-bodied touch, when one surface of the fabric is only lightly raised and the resulting extra fine surface effect is only slight, it is possible to change the total denier and yarn count of the first weft and of the third weft to a considerable degree as desired.

Weaving is so effected that the first weft and the third weft are floating wefts. For example, weaving may be so effected that the first weft may float more on one surface of the fabric than do the second or third wefts. Further, the third weft may float more on the other surface of the fabric than do the first weft or second weft. It is highly desirable to so structure the weave that the second weft, of relatively heavy denier, is at least partially hidden under, or concealed by, the floating wefts. For example, the weave pattern of the second weft may be the same as the weave pattern of the first weft, such that the reed of the loom forces the second weft under the first weft, so that the first weft of ultrafine fibers or filaments is predominantly exposed on the surface of the fabric and the second weft is predominantly concealed under the first weft, under the same surface of the fabric. The second weft may be similarly concealed under the third weft.

It is preferred that the number of warps skipped within a single weft float in the fabric should be about 2–12, more preferably about 3–8. Unless the textile weave is so set up that each thread of the first weft and of the third weft floats over or under the adjoining 2–12 threads of the warp, the raising property of the product is poor and a woven texture appears on the surface. Even if a highly stretchable yarn is used as the warp, it becomes difficult in such a case to obtain a raised woven fabric effectively achieving the objects of the present invention.

The numbers of warps skipped by the floating wefts on the front and back surfaces of the fabric may be the same or different. When they are different, the lengths of the naps on the front and the back surfaces of the fabric become different. When they are the same, the lengths of the naps on the front and back surfaces are correspondingly about the same.

A filamentary yarn or a spun yarn consisting mainly of a heavy denier fiber, of 1–20 denier, preferably 5–15 denier, for example, is used as the second weft. Because of the use of this second weft, and because of the use of a special warp as will be mentioned in detail hereinafter, drawbacks which exist in woven fabrics consisting of 100% extra fine fibers of less than 0.7 denier are overcome, and desirable effects such as permanent pleatability and crease resistance result.

The relatively heavy denier second weft, which has a high Young's modulus is so woven that it is positioned predominantly internally within the thickness of the woven fabric. Preferably, a special textile weave called a "float weave" or a "skip weave" is used, wherein the extra fine fibers or filaments of the first weft and of the third weft are so woven as to provide a majority of the ultrafine fibers or filaments exposed on the front surface and the back surface of the fabric. The second weft, which is the relatively thick fiber or filament, is so woven as to be located predominantly in the inner portion of the fabric and is at least partially covered by and concealed by at least one of the floating wefts.

By this technique the exposed front and the back surfaces of the fabric are occupied predominantly by extra fine fibers or filaments which can subsequently be napped or raised to provide the highly desirable surface effects. This effect can be accentuated by contracting the warp or by developing crimp therein. When the number of first weft and third weft fibers or filaments is greater than the number of second weft fibers or filaments, even better results are obtained. Likewise, when the total denier of the extra fine fibers or filaments of the first and third wefts is greater than the total denier of the heavy denier fibers or filaments of the second weft, excellent results are obtained.

Various textured filamentary yarns or spun yarns are preferably used as the second weft. Among the textured filamentary yarns, woolly false twisted yarns, Italian throwing yarns, ordinary false twist yarns and stuffer-box textured yarns are preferred. Composite fibers or filaments of types such as bimetal yarns, bimetal precision yarns, contracting mixed yarns and eccentric sheath-core yarns are also preferred. Indeed, it is possible to use as a second weft yarn a heavy denier yarn which can subsequently be converted into extra fine fibers or filaments, but has not yet been so converted. Fibers or filaments of the type which contract and recover twist are also preferred. Spun yarns which acquire bulkiness during processing are preferred. These are usually processed by relaxation, heating or treating fluids, in procedures well known per se and not further detailed herein.

In special fabrics woven in accordance with the present invention, the nature of the warp is not particularly limited. However, when the bending resistance, fabric resistance and crease resistance of the woven fabric are considered, it is especially preferable to use as a warp a filamentary yarn or spun yarn consisting mainly of a relatively heavy denier fiber or filament, of about 1–20 denier, preferably about 5–15 denier, just as in the case of the second weft. In this case, also, yarns of various types may be used, just as in the case of the second weft. The warp yarns may be either the same as the second weft or different. When the monofilament deniers of the second weft and of the warp are both less than about one denier, the resulting fabric tends to crease, to lose firmness and to become limp.

The total deniers of the warp and of the respective wefts are properly determined in accordance with the desired fabric properties sought, and are not particularly limited. However, in order to avoid a heavy-bodied impression and appearance in the fabric, it is preferable to provide a total denier within the range of less than about 150 denier, especially preferably less than about 100 denier.

Extra fine fibers or filaments, capable of use in the floating wefts in the practice of the present invention, are generally well known. For example, extra fine multi-component fibers or filaments such as islands-in-a-sea fibers, such as those disclosed in the U.S. Pat. to Okamoto et al, No. 3,531,368, or that to Morioka et al No. 4,122,658 may be used. In the alternative, splittable fibers or special polymer blend fibers or filaments may be used. For making extra-fine multi-component fibers, or filaments chemical or physical means such as dissolution or decomposition of one component, or mechanical splitting of all or part of one or more components from others may be restorted to. However, this invention is not particularly limited thereto. Further, yarn types made by super draw spinning, strong jet texturizing, air spinning and other types may be used as well.

The foregoing multi-component fibers or filaments may be made extra fine at any desired stage, either before or after weaving. However, it is preferable to convert these fibers or filaments to extra fine denier fibers or filaments after weaving in accordance with the present invention. By doing so, the weaving operation is enhanced and soft woven fabrics having the outstanding advantages of this invention may be produced.

Fabrics according to this invention may be woven on existing looms by making appropriate modifications with respect to yarn feeds. For example, when the same yarn is used for the front and back fabric surfaces, a loom having a 2×1 shuttle box may be used in a reciprocating manner. In the alternative, a 2×2 shuttle box which is a full-fledged multiple cloth loom is preferably used. Further, a Rapier loom may also be used, although the selvage of the resulting woven fabric tends to be inferior in this case.

Woven fabrics according to the present invention are often more effective when the first weft and/or the third weft is raised. This may be accomplished by carding or by emery raising, for example. However, when such weft is raised by use of a so-called raising machine, suede-like and velour-like raised surfaces are obtained which are elegant and which become even more elegant when dyed.

When a multi-component fiber or filament is used which becomes extra fine by removing one component therefrom, it is possible to effect raising before or after that removal. When a splittable multi-component fiber or filament is used which becomes extra fine by mechanical action (sometimes assisted by chemical action), it is possible to convert the fiber or filament into extra fine fibers or filaments and to raise them simultaneously. This is because the heavy denier fibers or filaments of the woven fabric can also be converted to extra fine fibers or filaments by raising operations per se, and it is also possible to render the fiber or filament susceptible of conversion to extra fine fibers or filaments by chemical or thermal assistance before or after raising. Further it is also preferable to raise or buff the fibers or filaments after these treatments have been completed.

Upon raising, it is preferable to apply a raising oiling agent, to render the fiber or filament susceptible to raising. Suitable buffing, raising and dissolving procedures are disclosed in the U.S. Patents heretofore referred to in this specification. Raising generally involves disturbance of some ultrafine fibers or filaments, breaking or looping them to provide a multiplicity of fine, exposed naps at the surface of the fabric.

Because substantially heavy denier fibers or filaments are used in the present invention as warp and as second weft, crease resistance both lengthwise and breadthwise of the fabric is drastically improved. Therefore, even if a high molecular weight elastomer is not used, woven fabric having good physical properties is nevertheless obtained. By not using such an elastomer as polyurethane, good results are realized in most cases such as avoiding decrease of fastness of color of the dyed woven fabric and avoiding deleterious change of the surface quality and feel of the product at the time of actual use because the elastomer such as polyurethane has relatively lower color fastness and relatively lower weather proofness.

Depending, however, upon the desired fabric qualities, for example, when it is desired to make a woven suede-like fabric, a high molecular weight elastomer may be used in combination with finish processing such as buffing, combing, brushing and dyeing, for example. In this case, the resiliency and packability of the fabric are improved.

In the use of such high molecular weight elastomers, various known binders of the polyurethane or polyacryl series may be utilized. These high molecular weight elastomers are applied in the form of solutions or emulsions.

Further, when it is desired to obtain good raised fibers or filaments, it is possible to apply temporary sizing to a fabric by applying one or more of various sizing agents, such as those of the polyvinyl alcohol series, and then high molecular weight elastomer is applied to the temporary sized fabric, and thereafter to remove this temporary sizing. This method brings about preferred results wherein naps are formed on both the front and back surfaces of the fabric. The use of such high molecular weight elastomer not only enhances the feel and resiliency of the fabric but also improves its slippage resistance, selvage tear resistance and cleanness of cut, which allows continuous cutting during processing operations.

Treatments for applying such high molecular weight elastomers or sizing agents to fabrics are well known per se, and are accordingly not further detailed herein.

Woven fabrics according to the present invention have, among others, the following excellent characteristics:

1. Crease resistance;
2. Permanent pleatability;
3. Excellent resiliency;
4. Soft touch on both front and back fabric surfaces;
5. Apparel can be made and used without a lining; and
6. Reversible high quality apparel.

Woven fabrics according to the present invention are useful in a broad range of fields and for a wide variety of purposes. They provide, for example, a means for making a strong filter having a heavy denier core which nevertheless can filter very fine particles. Fabrics according to this invention are useful in various articles of apparel (blazers, coats, hats, shoes, etc.), and for various furniture items, for carriers or pouches of all kinds, for use in various covers (bag grips, handle covers, book covers, etc.), in carpeting, in various industrial uses, and in musical instruments as well as in artificial flowers, and many other products, for example.

Hereinbelow, the present invention will be explained by reference to the following specific examples, which are intended to be illustrative and are not intended to limit the scope of the invention, which is defined in the appended claims.

EXAMPLE 1

A fabric was woven, using a 30 denier/6 filament filamentary polyethylene terephthalate yarn for the warp yarns. Sizing material was applied to the warp yarns as they were arranged in the loom. As both first and third wefts, a 240 denier/96 filament filamentary yarn, comprising an islands-in-a-sea type composite yarn, was used. The monofilament denier of the islands was 0.07.

Each island component consisted mainly of polyethylene terephthalate. The sea component consisted mainly of polystyrene. The percentage of the islands component was 96% by weight, and the percentage by weight of the sea component was 4%. The number of islands in a single sea was 36.

For use as the second weft, a 30 denier/6 filament polyethylene terephthalate false twist yarn was used.

Using the aforesaid warp and first, second and third wefts, a triple weft woven fabric was produced. The textile weave of the floating first and third wefts for the front and back surfaces was a 5-harness satin weave and the intermediate weave (second weft) was a $\frac{2}{3}$ twill weave. The woven density at this time was 134 warps/in and 269 wefts/in.

This woven fabric was passed through hot water at 95°-98° C. to remove the sizing agent and to apply a relaxation and contraction treatment to the fabric. The fabric was then dried by use of a hot air dryer at 120° C. and was thereafter contracted by heat setting and set to a reduced width using a hot air pin tenter dryer at 160°-180° C. The fabric was found to have contracted 7.8% longitudinally, 10.3% transversely and 17.3% in area.

This fabric was well washed 5 times with trichlorethylene, thus dissolving the polystyrene sea component and converting the first and third wefts into extra fine fibers or filaments. The fabric was then dried with a hot air dryer at 100° C. Thereafter, the fabric was dyed blue with a dispersed dyestuff in a circular pressing dyeing machine. An oil finishing agent was applied and thereafter the fabric was dried in a hot air pin tenter dryer at 100° C.

The resulting fabric was a high quality woven fabric for use in apparel. It had a silk-like luster on both surfaces, a relatively balanced warp and weft feel, and a soft surface touch. Garments manufactured therefrom did not require a lining.

EXAMPLE 2

The woven fabric obtained from the procedure of Example 1, after providing the same treatment for creating the extra fine fibers or filaments was raised twice on the front surface and twice on the back surface by use of an oil type hydraulic raising machine. These raisings were repeated over a total of 36 times. This produced a raised woven fabric the front and back surfaces of which were covered with a multiplicity of extra fine naps.

This woven fabric was subsequently dyed in a light brown color with a dispersed dyestuff using a circular press dyeing machine. An oil finishing agent was applied. Thereafter, the front and back surfaces of the dyed fabric were wet-brushed, and after the raised naps were evened, the dyed fabric was dried in a hot air pin tenter dryer at 100° C.

The resulting woven fabric was covered with compact naps on the front and back surfaces thereof, and had a soft touch without the appearance of a woven texture, but with a highly desirable tendency to show finger marks. It had a balanced warp and weft feel and was a puffy soft suede-like high quality woven fabric.

EXAMPLE 3

A compact triple ply loom was used with a 2×2 shuttle box having the ability to use three types of yarns as wefts. The first and second wefts were the same as in Example 1. The third weft, appearing on the back surface, was an islands-in-a-sea type yarn. The island component was nylon 6 and the sea component was a styrene/2-ethylhexylacrylate copolymer. The yarn was 200 denier/40 filament. The monofilament denier of each island component was 0.13 The percentage of island components was 95% and the number of islands was 36. The island components, after weaving, were converted into extra-fine fibers or filaments as in Examples 1 and 2, and the resulting dyed raised woven fabric was finished and cleaned.

The resulting woven fabric was a reversible suede of the two-surface raised type. Its front surface was light brown and its back surface was white.

EXAMPLE 4

A warp yarn was used comprising a 100 denier/18 filament yarn. Sizing agent was applied as the warp was arranged in the loom. A false twisted texturized yarn was used. As first and third wefts, 245 denier/40 filament yarns of the islands-in-a-sea type were used. The monofilament denier was 0.15. The island components consisted mainly of polyethylene terephthalate, while the sea component consisted mainly of polystyrene. The percentage of island components was 88%, the percentage of sea components was 12%, and the number of islands was 36. As the second weft, a 75 denier/12 filament polyethylene terephthalate filamentary yarn was used, having a monofilament denier of 6.3.

The aforesaid warp and first, second and third wefts were woven into a woven fabric of triple weft weave. The front and back surfaces were formed of a 5-harness satin weave. The intermediate textile weave was a $\frac{2}{3}$ twill weave. The woven density at this time was 115 warps per inch and 183 wefts per inch.

This woven fabric was immersed in hot water at 95°-98° C. to effect removal of the sizing agent, and was subjected to a relaxation and contraction treatment. It was then dried in a hot air dryer at 120° C. and thereafter heat-set at the contracted width by use of a hot air pin tenter dryer at 160°-180° C. The fabric was found to have contracted 10.3% longitudinally, 9.5% transversely and 18.8% in area.

The woven fabric was then washed 7 times with trichloroethylene to dissolve the sea components of the first and third wefts and was then dried in a hot air dryer at 100° C. The dried fabric was treated with a raising oiling agent. Its front surface was passed through a French-style raising machine 18 times and its back surface was passed through said raising machine 15 times, a total of 33 times, to produce a raised woven fabric having its front and back surfaces covered with extra-fine naps.

After raising, a pin tenter dryer was used to effect heat-setting at a temperature within the range of 160°-180° C. Thereafter the raised woven fabric was dyed green with a dispersed dyestuff using a circular press dyeing machine and treated with a finish oiling agent. Thereafter, both the front and back surfaces were brushed in the wet state to even out the raised naps. The fabric was then dried in a hot air pin tenter dryer at 100° C. and finished.

The resulting woven fabric was a suede-like, high quality woven fabric having both surfaces raised. Its woven texture was difficult to detect. Both of its surfaces were covered with dense naps having a soft touch, tending to take on finger marks and having a balanced warp and weft feel.

EXAMPLE 5

In this Example, the same type yarn was used as warp and as second weft. It was a 75 denier/12 filament yarn. The monofilament denier was 6.3. Polyethylene terephthalate was used.

A very different type yarn was used for the first and third wefts. It was a 200 denier/40 filament yarn of the islands-in-a-sea type. The monofilament denier was 0.07. The island component consisted mainly of polyethylene terephthalate while the sea component consisted mainly of polystyrene. The percentage of island component was 93%, and the percentage of sea component was 7%. The number of islands was 70.

The aforesaid warp and first, second and third wefts were woven into a triple weft woven fabric. The front surface textile weave was an 8-harness satin, and the back surface textile weave was a 2/2 twill. The intermediate textile weave was $\frac{1}{3}$ twill weave. The woven density at this time was 115 warps per inch and 200 wefts per inch.

This woven fabric was treated the same as in Example 4.

The resulting fabric was a suede-like, high quality raised woven fabric. Both of its surfaces were raised, and longer naps (2.5-3.0 mm) were provided on the front surface than on the back surface (0.6-1.0 mm). The fabric had a soft touch and a balanced warp and weft feel. It did not tend to crease, and had a tendency to take on finger marks.

Besides these, many other variations are possible, such as variations of the manner of dyeing, (for example, making the front surface dyeable with a dispersed dyestuff and making the back surface dyeable with a basic dyestuff), variations with respect to the specific polymers used, variations of cross sectional configurations of the fibers or filaments, variations of copolymerization parameters, variations of the denier mix, variations of the material mix, variations of the number of divisions when composite fibers or filaments are split and used in the fabric, variations of the degree of raising of the nap when the fabric is formed into a raised woven fabric, and variations of applications of additional post-processing steps and conditions, for example. Many combinations of these variables may be resorted to, all within the aforementioned limitations.

As used herein, the term "consisting mainly of", when used in defining the aforesaid fibers, filaments and yarns also includes fabrics in which other fibers or filaments or yarns, which are outside the range of the definition, are mixed with the defined fibers or filaments. It also includes fabrics in which one or more added substances, such as adhesives, lubricants, dyes or the like are adhered to the defined fibers or filaments in an amount which does not substantially interfere with the outstanding properties of the fabrics of the present invention. For example, it is possible to mix at least one heavy denier fiber or filament into a large group containing many extra fine fibers or filaments without departing from the scope of this invention or to combine another component with an extra fine fiber or filament component, which other component remains as a yarn having a deformed cross-sectional configuration upon producing extra fine fibers by splitting multi-component filaments. Also, it is possible to utilize a multi-component fiber or filament which can be converted into extra fine fibers, but which at least temporarily remains uncovered. Various other modifications may be made, which do not interfere with the foregoing advantages of the present invention, and are intended to be included within the scope of the present invention.

Although this invention has been described with reference to specific yarns and fabrics, and to specific woven patterns, it will be appreciated that equivalent yarns, fabrics and patterns may be substituted, and that certain features may be used independently of other features, all without departing from the spirit and scope of the invention as defined in the appended claims.

We claim:

1. A woven fabric comprising a warp and at least three separate wefts woven with said warp, at least two of said wefts being floating wefts each comprising a yarn consisting mainly of extra-fine fibers or filaments having monofilament deniers of less than about 0.7, and another of said wefts comprising filamentary or spun yarn comprising mainly fibers or filaments of about 5-15 denier, and said warp comprising filamentary or spun yarn comprising mainly fibers or filaments of about 5-15 denier, wherein a greater portion of one of said floating wefts is exposed on one surface of said fabric than are the other wefts on said surface and wherein a greater portion of another said floating weft is exposed on the other surface of said fabric than are the other wefts on said other surface.

2. The woven fabric defined in claim 1, wherein at least one of said floating wefts is raised.

3. The woven fabric defined in claim 1, wherein said floating wefts are composed of filamentary or spun yarn consisting mainly of extra-fine fibers or filaments having deniers of about 0.03–0.25.

4. The woven fabric defined in claim 1, wherein the monofilament deniers and the total deniers of both said floating wefts are substantially the same.

5. The woven fabric defined in claim 1, wherein the fabric is reversible and wherein the numbers of the floating wefts on opposed surfaces of the fabric are about the same.

6. The woven fabric defined in claim 1, wherein the number of warp yarns skipped by said floating wefts is about 2–12.

7. The woven fabric defined in claim 6, wherein the number of warp yarns skipped by said floating wefts is about 3–8.

8. The woven fabric defined in claim 1, wherein said warp and substantially all of said floating wefts are composed essentially of polyester fibers or filaments.

9. The woven fabric defined in claim 1, wherein said warp consists of fibers or filaments capable of developing contraction or crimp.

10. The woven fabric defined in claim 1, wherein the total denier of each said floating weft is greater than the total denier of said weft which has a denier of about 1–20.

11. The woven fabric defined in claim 1, wherein said floating wefts are located predominantly along the surfaces of the fabric and wherein the other weft is located predominantly in the inner portion of the fabric, and at least partially concealed by at least one of said floating wefts.

12. A woven fabric comprising a warp and at least three separate wefts woven with said warp, at least two of said wefts being floating wefts each comprising a yarn consisting mainly of extra-fine fibers or filaments having monofilament deniers of less than about 0.7, and another of said wefts comprising filamentary or spun yarn comprising mainly fibers or filaments of about 5–15 denier, and said warp comprising filamentary or spun yarn comprising mainly fibers or filaments of about 5–15 denier, wherein a greater portion of one of said floating wefts is exposed on one surface of said fabric than are the other wefts on said surface and wherein a greater portion of another said floating weft is exposed on the other surface of said fabric than are the other wefts on said other surface wherein the density of weave is greater than about 100 warps per inch and greater than about 180 wefts per inch.

13. A woven fabric comprising a warp and at least three separate wefts woven with said warp, at least two of said wefts being floating wefts each comprising a yarn consisting mainly of extra-fine fibers or filaments having monofilament deniers of less than about 0.7, and another of said wefts comprising filamentary or spun yarn comprising 5–15 denier, is selected from the group consisting of textured filamentary yarns, false twist yarns and stuffer-box textured yarns, and said warp comprising filamentary or spun yarn comprising mainly fibers or filaments of about 5–15 denier, wherein a greater portion of one of said floating wefts is exposed on one surface of said fabric than are the other wefts on said surface and wherein a greater portion of another said floating weft is exposed on the other surface of said fabric than are the other wefts on said other surface.

* * * * *